US005216952A

United States Patent [19]

Hoff et al.

[11] Patent Number: 5,216,952

[45] Date of Patent: Jun. 8, 1993

[54] BRUSH-TYPE DAMPENING UNIT IN A ROTARY PRINTING MACHINE

[75] Inventors: Howard W. Hoff, Lee, N.H.; David C. Emery, York, Me.; David V. Reed, Somersworth, N.H.

[73] Assignee: Heidelberg Harris GmbH, Heidelberg, Fed. Rep. of Germany

[21] Appl. No.: 712,243

[22] Filed: Jun. 7, 1991

[51] Int. Cl.[5] ..... B41L 25/00

[52] U.S. Cl. ..... 101/148; 101/147; 118/257; 118/258; 239/215

[58] Field of Search ..... 101/147, 148; 239/214, 239/215, 218; 222/342, 415; 118/300, 257, 258

[56] References Cited

U.S. PATENT DOCUMENTS

| | | | |
|---|---|---|---|
| 2,009,652 | 7/1935 | Conwill | 239/218 |
| 2,868,118 | 1/1959 | Dahlgren | 101/147 |
| 4,034,670 | 7/1977 | Zavodny | 101/148 |
| 4,143,596 | 3/1979 | Ivett | 101/148 |
| 4,970,953 | 11/1990 | Reponty | 101/148 |
| 5,038,679 | 8/1991 | Moroz | 101/147 |

FOREIGN PATENT DOCUMENTS

| | | | |
|---|---|---|---|
| 3446675 | 6/1986 | Fed. Rep. of Germany | 101/148 |
| 0158252 | 7/1988 | Japan | 101/147 |

*Primary Examiner*—Edgar S. Burr
*Assistant Examiner*—Lynn D. Hendrickson
*Attorney, Agent, or Firm*—Herbert L. Lerner; Laurence A. Greenberg

[57] ABSTRACT

A brush-type dampening unit in a rotary printing machine, includes at least one revolving carrier member having a multiplicity of brush bristles arranged thereon a pan roller dipping at least partly into a dampening-fluid pan, and revolving in a direction opposite to that of the carrier member, adjusting means for adjusting the position of the carrier member with respect to the pan roller, the revolving carrier member and pan roller having respective separately controllable drives independent of a drive of the printing machine, and means for zonally metering a quantity of dampening fluid over the width of the machine, as well as for influencing a direction of movement of the dampening fluid.

10 Claims, 2 Drawing Sheets

BRUSH-TYPE DAMPENING UNIT IN A ROTARY PRINTING MACHINE

Figure 1:
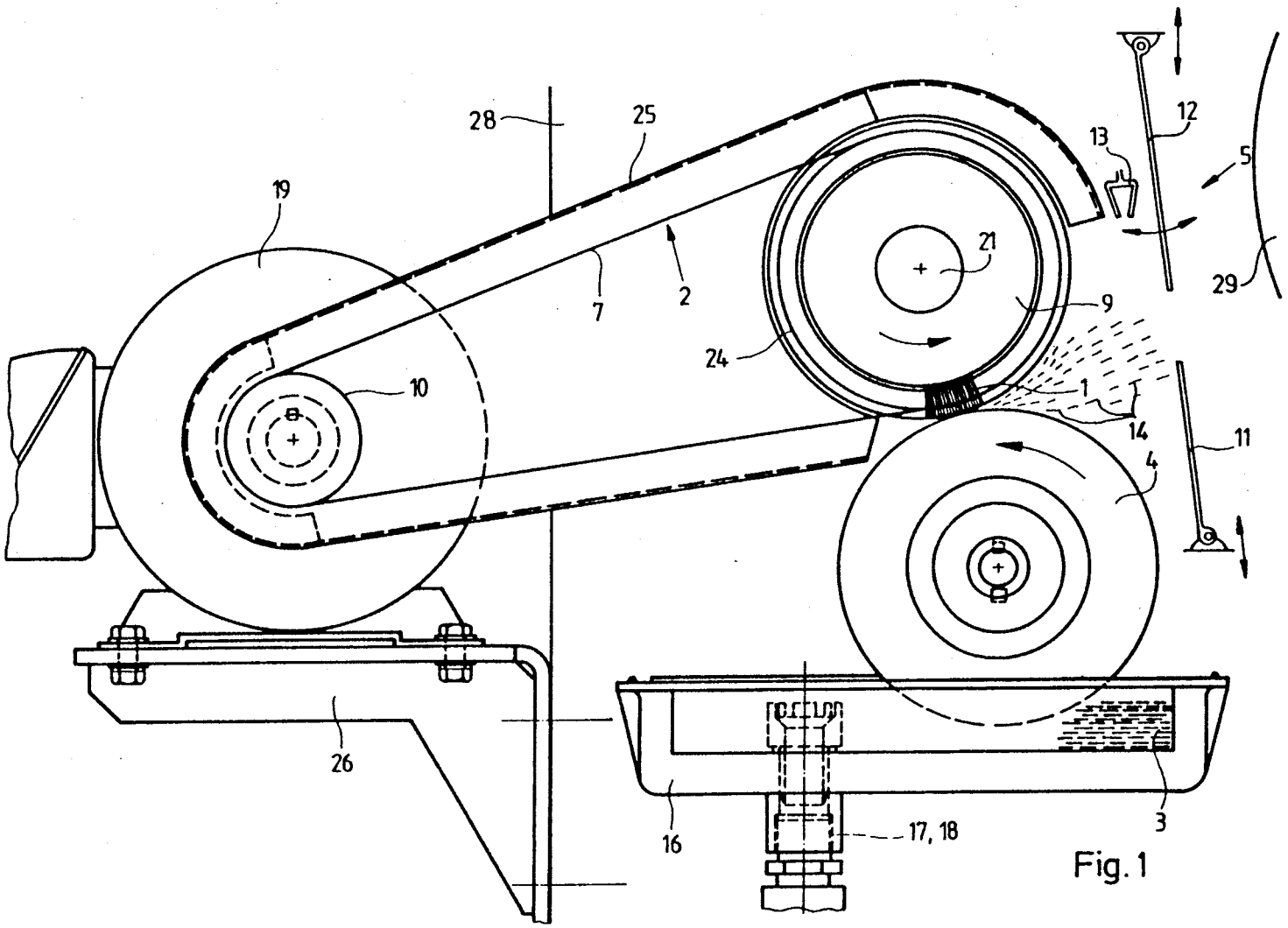

The invention relates to a brush-type dampening unit in a rotary printing press.

From the prior art exemplified by U.S. Pat. No. 2,868,118, there has become known a brush-type dampening unit in which a brush roller and a pan or dipping roller is moved by means of a combined chain/belt drive, and the pan roller, which rotates in a dampening-fluid pan, is coupled via several gear wheels with a drive of the printing machine for the cylinders of the printing units thereof, and is driven at the speed of the printing machine. With the aid of a lever mechanism, the brush roller, at impression throw off, is disengaged from the pan roller. By means of a control cam, mounted on the shaft of the plate cylinder, the brush roller, at each rotation of the plate cylinder, is always then disengaged from the pan roller, when the cylinder channel is located opposite the brush roller. In the time period during which the channel rotates pass the brush roller, the spraying of dampening fluid is also interrupted.

A disadvantage of this state-of-the-art construction is the impact which is caused by the frequent engagement and disengagement affected by the lever mechanism in the brush-type dampening unit. The smooth running of the printing machine is thereby considerably impaired. The frequent engagement and disengagement of the brush roller, furthermore, results in a metering of dampening-fluid spray which is invariably time-delayed. The bristles of the brush roller store a given amount of dampening fluid, and a given amount of time is necessary until a new adjustment is achieved. Moreover, the rotation of the pan roller is prescribed always by the speed of the printing machine and is not independently adjustable.

It is accordingly an object of the invention to provide a brush-type dampening unit which avoids these disadvantages of the state of the art. Proceeding from this state of the art, it is accordingly an object of the invention, to provide such a unit wherein a continuing supply of dampening fluid to printing-unit cylinders of a rotary printing machine is assured, and thus mutual overcontrol or overdrive of the dampening-fluid carriers is excluded.

With the foregoing and other objects in view, there is provided, in accordance with the invention, a brush-type dampening unit in a rotary printing machine, comprising at least one revolving carrier member having a multiplicity of brush bristles arranged thereon, a pan roller dipping at least partly into a dampening-fluid pan, and revolving in a direction opposite to that of the carrier member, adjusting means for adjusting the position of the carrier member with respect to the pan roller, the revolving carrier member and pan roller having respective separately controllable drives independent of a drive of the printing machine, and means for zonally metering a quantity of dampening fluid over the width of the machine, as well as for influencing a direction of movement of the dampening fluid.

It is advantageous that the rotating carrier members and the pan roller do not mutually brake or accelerate, because they, respectively, have separate drives available to them. These separate drives are controllable from a central control station or console of the printing machine, and permit a fast change of the amount of dampening-fluid supplied. In addition, the quantity of dampening fluid, can be controlled and adjusted objectively in especially interesting inking zones of the rotary printing machine.

In accordance with another feature of the invention, the carrier member is a rotating roller having bristles arranged on a peripheral surface thereof.

In accordance with an alternative feature of the invention, the at least one carrier member is an endless belt and has additional belts arranged adjacent one another, the endless belts having bristles arranged thereon.

An additional advantage of these alternate constructions is the high bristle density which can be moved past the pan roller, so that a finely distributed spray or mist occurs.

In accordance with a further feature of the invention, the brush-type dampening unit includes an adjusting unit operatively connected with the roller for adjusting a spacing between a rotational axis of the roller with bristles and a rotational axis of the pan roller.

In accordance with an alternative feature of the invention, the brush-type dampening unit includes an adjusting unit operatively connected with the revolving endless belts for adjusting a spacing between a rotational axis of the revolving rollers carrying the endless belts formed with bristles thereon and a rotational axis of the pan roller. The advantage of these alternative features is the relatively easy adjustment of the contact pressure between the bristles and the surface of the pan roller.

In accordance with an added feature of the invention, the metering means are responsive to differences in speed between the bristles on the at least one carrier member, and the pan roller for metering the dampening fluid. The adjustment of speed differential occurring by means of the respective drives, permits control of the dampening fluid over a wide metering range.

In accordance with an additional feature of the invention, a plurality of the revolving endless belts arranged adjacent one another are displaceable in a direction parallel to printing-unit cylinders of the printing machine. It is possible thereby for a zonally different dampening of regions of the printing plate to be undertaken, and sought-after, job-specific requirements as to print quality to be met.

In accordance with yet another feature of the invention, the metering means comprise movable metering shields for metering a quantity of the dampening fluid fed to printing-unit cylinders of the rotary printing machine. This permits control of the quantity of dampening fluid without having to influence the rotary speed of the drives and without having to intervene in the production of spray. Simple swivelling or reciprocating movement of the deflector shields permits a possibility of metering after the spray has been made-ready.

In accordance with yet a further feature of the invention, the metering means include at least one nozzle having a discharging air jet for controlling a direction of movement of droplets of the dampening fluid. The advantage of this construction is in the possibility of having an effect, in rather simple fashion, on the finely distributed spray which has been produced.

In accordance with a concomitant feature of the invention, the at least one nozzle is directed so that the discharging air jet thereof causes a mixing of the droplets of dampening fluid to occur.

Other features which are considered as characteristic for the invention are set forth in the appended claims.

Although the invention is illustrated and described herein as embodied in a brush-type dampening unit in a rotary printing machine, it is nevertheless not intended to be limited to the details shown, since various modifications and structural changes may be made therein without departing from the spirit of the invention and within the scope and range of equivalents of the claims.

Figure 2:
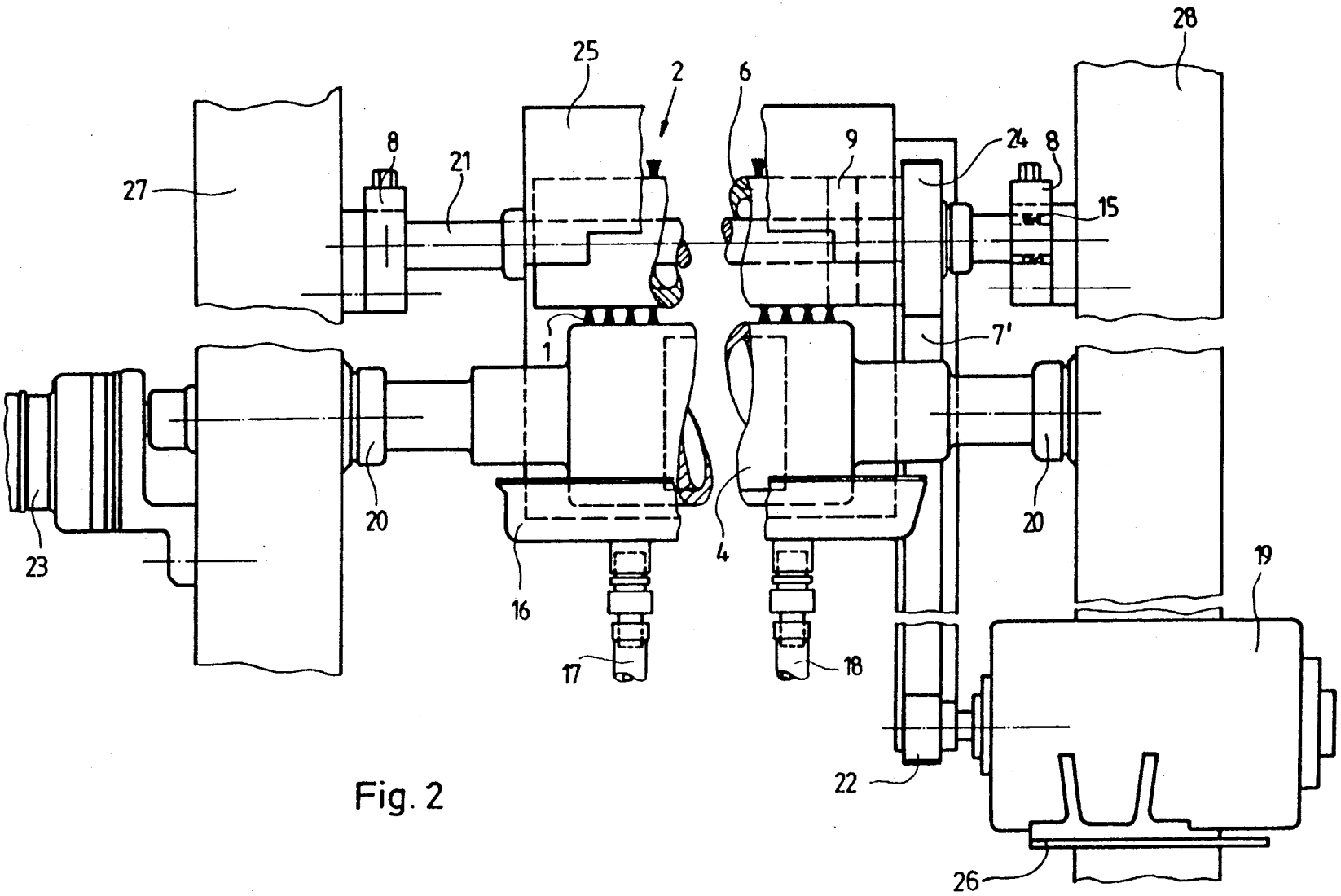

The construction and method of operation of the invention, however, together with additional objects and advantages thereof will be best understood from the following description of specific embodiments when read in connection with the accompanying drawings, in which:

FIG. 1 is a side elevational view of one embodiment of a brush-type dampening unit according to the invention; and FIG. 2 is a front elevational view of FIG. 1, as seen from the right-hand side of the latter, with deflecting shields removed, of another embodiment of the invention.

Referring now to the drawing and, first, particularly to FIG. 1 thereof, there is shown in a side elevational view, a dampening unit according to the invention. Bristles 1 are disposed on an outwardly projecting side of carrier or support members 2. The carrier members 2 for the bristles 1 can be formed as endless belts or tapes 7 as in FIG. 1, or as a roller 6 (FIG. 2). On the outer cylindrical surface of the tape 7, as can be seen in the embodiment of FIG. 1, a multiplicity of bristles 1 are arranged in high packing density, in order to remove dampening fluid 3 from a rotating dip or pan roller 4 in a dampening-fluid pan 16 and produce a fine spray therefrom which is then distributed over or applied to a cylinder 29 of a printing unit.

Another conceivable embodiment of the invention calls for the provision of an alternating arrangement of short and long rows of bristles 1 located one behind the other. With this arrangement, another spray construction or combination can be achieved. FIG. 2 shows adjusting units 8 by means of which rotational axes of the pan roller 4 and the brush roller 6 are movable towards one another or, if necessary or desirable, away from one another. For a predetermined height and distribution of the bristles 1 on the outer cylindrical surface of the brush roller 6, a respective higher or lower contact force is achieved. Predetermined fluid characteristics of the dampening fluid 3 can produce a different spray characteristic, due to a variation in spacing.

The change in spacing is, naturally, also realizable in an embodiment of the invention wherein the bristles I are arranged on revolving belts or tapes, as in FIG. 1. In such an embodiment, the revolving wheels 9, through the adjustment units 8, can be brought into engagement with or disengagement from the pan roller 4. This has the same effect as deflecting the bristles 1. This can also have an effect upon the bending of the revolving bristles. Other possibilities of metering the dampening fluid which is to be sprayed are that the roller 6 of FIG. 2 and the pan roller 4 can be permitted to rotate at different speeds with respect to one another. A relative change of the radii of both of the rollers 4 and 6 is also possible. A more extensive possibility for varying the quantity of dampening fluid can be accomplished by influencing the fluid characteristics, such as viscosity, for example, through increasing the temperature of the dampening fluid.

As is shown in FIG. 2, the roller 6 having the bristles 1 arranged on the outer cylindrical surface thereof is driven by a belt 7'. The belt 7' runs over a drive roller or wheel 22 which is driven, in turn, by a motor 19. A belt pulley 24 is assigned to the roller 6. The motor 19 is threadedly fastened to a bracket 26, which is, in turn, fastened to a side wall 28 of the printing machine.

The embodiment of the invention shown in FIG. 1 provides, instead of the roller 6, several belts or tapes 7 arranged adjacent one another across the width of the machine. On the upper surface of the belts or tapes 7, in a manner similar to that for the roller 6 of FIG. 2, there are arranged bristles 1 of identical or varying height and elasticity, from which the dampening fluid 3 is sprayed into a printing unit. Because several endless belts or tapes 7 can be arranged over the width of the machine, it is possible to provide a zonal metering or dosing of the quantity of dampening fluid entering the printing unit. The dampening-fluid distribution can be individually matched with or accommodated to individual printing orders or jobs. In this regard, besides a uniform spray distribution an unevenly distributed spraying in accordance with processing requirements can be realized with set crucial points achieved. As shown in FIG. 2, a separated drive from two separate motors 19 and 23 hinders the acceleration or braking of the pan roller 4 by the roller 6 and the acceleration or braking of the roller 6 by the pan roller 4. The rotational speed set by the operator remains constant, nor does it vary during operation.

In FIG. 1, additional arrangements 5 are disclosed, by which the distribution of droplets 14 within the spray and the direction of movement of the droplets 14 are influenced. In adjustable bearings, pivotable metering or deflector shields 11 and 12 are arranged and ensure that, upon demand or requirement, a zonal influencing of the spray is possible, without interfering with the production of the spray. The revolving speed of the belt or tape provided with the bristles 1, the pan roller 4 or, if necessary or desirable, the roller 6, can remain unchanged. The metering of the spray occurs solely due to adjusting or shifting the metering shields 11 and 12. Furthermore, several nozzles 13 having discharging air jets may be arranged over the width of the machine and serve not only to create a diversion or deflection of the droplets 14 of spray, but also accomplish a purposeful or sought-after mixing of the spray, depending upon requirements.

FIG. 2 is a view from the right-hand side of FIG. 1 of the dampening unit, according to the invention. It can be seen therefrom, that the pan roller 4 rotating in the dampening-fluid pan 16 is supported in bearings 20 mounted in the side walls 27 and 28 of the printing machine. A cover 25 ensures that any of the dampening fluid 3 which spatters is caught and collected. Moreover, the dampening-fluid pan 16 is furthermore tied into a dampening-fluid inlet 17 and a dampening-fluid outlet 18. A shaft 21 either carriers a brush roller 6 or several mutually adjacent revolving rollers 9 (FIG. 1) which, in turn, guide the endless belts or tapes 7 having bristles 1 covering the outside thereof. Bearings 15 (FIG. 5) of the shaft 21 are accommodated in the adjusting units 8.

We claim:

1. Brush-type dampening unit in a rotary printing machine having a printing-unit cylinder of given width, comprising at least one revolving carrier member having a multiplicity of brush bristles arranged thereon, said carrier member being proximal to the printing-unit cylinder of the rotary printing machine, a pan roller dipping at least partly into a dampening-fluid pan and revolving in a direction opposite to that of said carrier member, adjusting means for adjusting the position of said carrier member with respect to said pan roller, said revolving carrier member and pan roller having respective separately controllable drives independent of a drive of the printing machine, and means for zonally metering a quantity of dampening fluid directly from said brush bristles onto the printing-unit cylinder over the width of the printing-unit cylinder, as well as for influencing a direction of movement of the dampening fluid.

2. Brush-type dampening unit according to claim 1, wherein said carrier member is a rotating roller having bristles arranged on a peripheral surface thereof.

3. Brush-type dampening unit in a rotary printing machine having a printing-unit cylinder of given width, comprising at least one revolving carrier member having a multiplicity of brush bristles arranged thereon, a pan roller dipping at least partly into a dampening-fluid pan, and revolving in a direction opposite to that of said carrier member, adjusting means for adjusting the position of said carrier member with respect to said pan roller, said revolving carrier member and pan roller having respective separately controllable drives independent of a drive of the printing machine, and means for zonally metering a quantity of dampening fluid over the width of the machine, as well as for influencing a direction of movement of the dampening fluid, said at least one carrier member being and endless belt and having additional belts arranged adjacent one another, said endless belts having bristles arranged thereon.

4. Brush-type dampening unit according to claim 2, including and adjusting unit operatively connected with said roller for adjusting a spacing between a rotational axis of said roller with bristles and a rotational axis of said pan roller.

5. Brush-type dampening unit according to claim 3, including revolving rollers for carrying said endless belts, said revolving rollers having a rotational axis, and an adjusting unit operatively connected with said revolving endless belts for adjusting a spacing between said rotational axis of said revolving rollers and a rotational axis of said pan roller.

6. Brush-type dampening unit according to claim 1, wherein said metering means are responsive to differences in speed between said bristles on said at least one carrier member, and said pan roller for metering said dampening fluid.

7. Brush-type unit according to claim 3, wherein the printing-unit cylinder has a rotary axis, and wherein a plurality of said revolving endless belts arranged adjacent one another are displaceable in a direction parallel to the axis of the printing-unit cylinder.

8. Brush-type dampening unit according to claim 1, wherein said metering means comprise movable metering shields disposed intermediate said carrier member and the printing-unit cylinder for metering the quantity of said dampening fluid fed directly to the printing-unit cylinder.

9. Brush-type dampening unit according to claim 1, wherein said metering means include at least one nozzle having a discharging air jet for controlling a direction of movement of droplets of said dampening fluid.

10. Brush-type dampening unit according to claim 9, wherein said at least one nozzle is directed so that said discharging air jet thereof causes a mixing of said droplets of dampening fluid to occur.

* * * * *